US012691547B2

(12) United States Patent
Decena et al.

(10) Patent No.: US 12,691,547 B2
(45) Date of Patent: Jul. 28, 2026

(54) CMP INNER RING IN SMART HEAD

(71) Applicant: Applied Materials, Inc., Santa Clara, CA (US)

(72) Inventors: Michael Prestoza Decena, Sunnyvale, CA (US); Tsu-Hui Yang, Dongkung Town (TW); Sridhar K. N., Bangalore (IN); Parthiban Balakrishnan, Bangalore (IN); Yuan Ling, Hsinchu City (TW); Sylvia Sun, Hsinchu City (TW); Simpson Wen, Hsinchu City (TW); Chih An Chang, Taoyuan City (TW); Tk Wang, Hsinchu City (TW); Chao-Jian Huang, Tainan City (TW)

(73) Assignee: Applied Materials, Inc., Santa Clara, CA (US)

( * ) Notice: Subject to any disclaimer, the term of this patent is extended or adjusted under 35 U.S.C. 154(b) by 288 days.

(21) Appl. No.: 18/373,657

(22) Filed: Sep. 27, 2023

(65) Prior Publication Data

US 2025/0100105 A1 Mar. 27, 2025

(51) Int. Cl.
*B24B 41/06* (2012.01)
*B24B 37/30* (2012.01)

(52) U.S. Cl.
CPC ..... *B24B 41/06* (2013.01); *B24B 37/30* (2013.01)

(58) Field of Classification Search
CPC ..... B24B 7/228; B24B 37/005; B24B 37/10; B24B 37/105; B24B 37/107; B24B 37/27; B24B 37/30; B24B 37/32
USPC ..... 451/41, 285, 286, 287, 288, 289, 388, 451/398
See application file for complete search history.

(56) References Cited

U.S. PATENT DOCUMENTS 11,173,579 B2 * 11/2021 Chen ..... B24B 41/06
2002/0037693 A1 3/2002 Lougher et al.
2002/0182995 A1 12/2002 Shendon et al.
(Continued)

FOREIGN PATENT DOCUMENTS

KR 20100007649 A * 1/2010 ..... B24B 37/30
WO 2012019144 A2 2/2012
WO 2021035080 A1 2/2021

OTHER PUBLICATIONS

Machine translation of KR-20100007649-A (Year: 2010).*
International Search Report and Written Opinion issued to Application No. PCT/US2024/044790 on Dec. 11, 2024 in 15 pages.

*Primary Examiner* — Robert F Neibaur
(74) *Attorney, Agent, or Firm* — Patterson + Sheridan, LLP

(57) ABSTRACT

The disclosure provides an apparatus for substrate polishing, the apparatus includes a housing member, a carrier member, and a distal force assembly. The carrier member is coupled to and disposed radially outward of the housing member. The distal force assembly disposed radially inward of an exterior portion of the carrier member and radially outward of the housing member. The distal force assembly includes a bladder seal, a seal ring in contact with the bladder seal. The seal ring has a seal ring face and one or more grooves disposed therein. The grooves include a plateau radius and a ridge radius disposed opposite the plateau radius at an intersection between the seal ring face and the grooves, wherein the plateau radius and the ridge radius are between about 0.012 to about 0.018 inches. The distal force assembly also includes a transfer ring coupled to the seal ring opposite the bladder.

14 Claims, 4 Drawing Sheets

(56) References Cited

U.S. PATENT DOCUMENTS

| | | | | |
|---|---|---|---|---|
| 2004/0198011 | A1* | 10/2004 | Togawa | B24B 37/30 438/321 |
| 2008/0119120 | A1* | 5/2008 | Zuniga | B24B 37/30 451/288 |
| 2010/0273405 | A1* | 10/2010 | Fukushima | B24B 37/30 451/449 |
| 2022/0111482 | A1 | 4/2022 | Zuniga et al. | |

* cited by examiner

CMP INNER RING IN SMART HEAD

BACKGROUND

Field

Embodiments of the present invention generally relate to chemical mechanical polishing (CMP) systems used in the manufacturing of semiconductor devices. In particular, embodiments herein relate to apparatus and method for uniform processing of a substrate near the edges during CMP processing.

Description of the Related Art

Chemical mechanical polishing (CMP) is commonly used in the manufacturing of semiconductor devices to planarize or polish a layer of material deposited on a substrate surface. In a typical CMP process, a substrate is retained in a carrier which presses the backside of the substrate towards a rotating polishing pad in the presence of a polishing fluid. Generally, the polishing fluid comprises an aqueous solution of one or more chemical constituents and nanoscale abrasive particles suspended in the aqueous solution. Material is removed across the material layer surface of the substrate in contact with the polishing pad through a combination of chemical and mechanical activity which is provided by the polishing fluid and the relative motion of the substrate and the polishing pad.

The carrier includes various internal components that are subject to wear due to the significant forces and movements during processing. A damaged carrier decreases manufacturing efficiency, thereby increasing process costs. Accordingly, there is a need in the art for articles and related methods that solve the problem described above.

SUMMARY

In one embodiment, an apparatus for substrate polishing is provided, the apparatus includes a housing member, a carrier member, and a distal force assembly. The carrier member is coupled to and disposed radially outward of the housing member. The distal force assembly disposed radially inward of an exterior portion of the carrier member and radially outward of the housing member. The distal force assembly includes a bladder seal, a seal ring in contact with the bladder seal. The seal ring has a seal ring face and one or more grooves disposed therein. The grooves include a plateau radius and a ridge radius disposed opposite the plateau radius at an intersection between the seal ring face and the grooves, wherein the plateau radius and the ridge radius are between about 0.012 to about 0.018 inches. The distal force assembly also includes a transfer ring coupled to the seal ring opposite the bladder.

In another embodiment, a distal force assembly for use in a substrate carrier is provided the distal force assembly includes a bladder seal, a seal ring in contact with the bladder, and a transfer ring. The seal ring has a seal ring face and one or more grooves disposed in the seal ring face. The grooves include a plateau radius disposed at an intersection between the seal ring face and the groove; and a ridge radius disposed opposite the plateau radius at an intersection between the seal ring face and the grooves, wherein the plateau radius and the ridge radius are between about 0.012 to about 0.018 inches. The transfer ring is coupled to the seal ring opposite the bladder In yet another embodiment, a metal seal ring is provided for use in a distal force assembly of a substrate polishing apparatus. The metal seal ring includes a plateau region disposed between grooves. The plateau region and two grooves are disposed on a seal ring face of the seal ring. The two grooves include a plateau radius disposed at an intersection between the seal ring face and the groove and a ridge radius disposed opposite the plateau radius at an intersection between the seal ring face and the grooves, wherein the plateau radius and the ridge radius are between about 0.012 to about 0.018 inches.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments of the disclosure and are therefore not to be considered limiting of its scope, as the disclosure may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Embodiments of the present disclosure generally relate to apparatus for reducing the impact of a substrate against the inside surface of a retaining ring during substrate polishing. In particular, embodiments herein relate to a chemical mechanical polish (CMP) system with an extension disposed radially outward from a substrate chuck member and the outer edge of the substrate.

Figure 1:
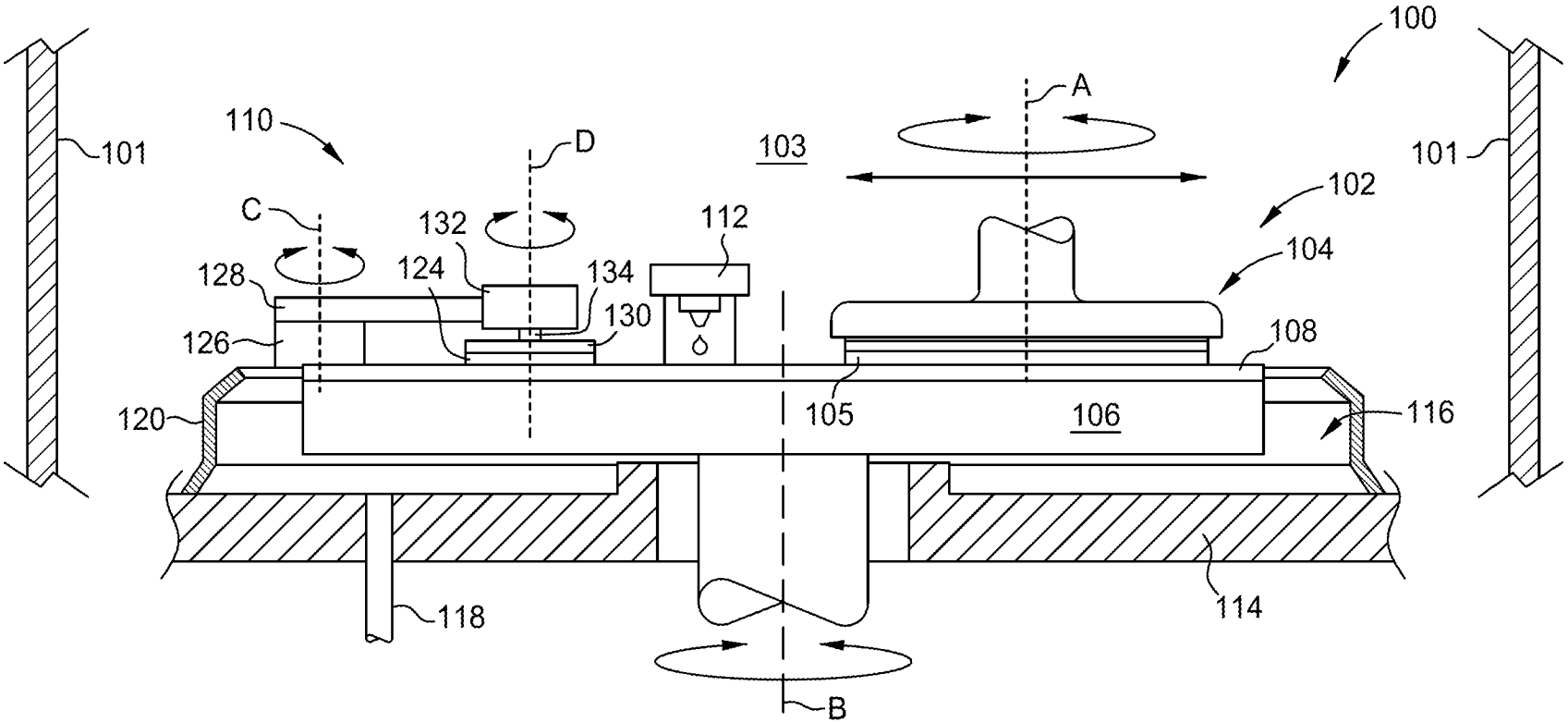
FIG. 1 is a schematic side view of a polishing system for use according to embodiments disclosed herein.

FIG. 1 is a schematic side view of a polishing system 100 for use according to embodiments disclosed herein. Typically, the polishing system 100 features a frame (not shown) and a plurality of panels 101 which define a substrate processing environment 103. The polishing system 100 includes a plurality of polishing stations 102 (one shown) and a plurality of carrier assemblies 104 (one shown) which are disposed within the substrate processing environment 103.

As shown in FIG. 1, the polishing station 102 includes a platen 106, a polishing pad 108 mounted on the platen 106 and secured thereto, a pad conditioner assembly 110 for cleaning and/or rejuvenating the polishing pad, and a fluid delivery arm 112 for dispensing polishing fluid onto the polishing pad 108. Here, the platen 106 is disposed above a base plate 114 and is circumscribed by a platen shield 120 (both shown in cross section) which collectively define a drainage basin 116. The drainage basin 116 is used to collect fluids spun radially outward from the platen 106 and to drain the fluids through a drain 118 in fluid communication therewith.

The pad conditioner assembly 110 is used to clean and/or rejuvenate the polishing pad 108 by sweeping polishing byproducts therefrom, such as with a brush (not shown), and/or by abrading the polishing pad 108 by urging an abrasive pad conditioning disk 124 (e.g., a diamond impregnated disk) there against. Pad conditioning operations may be done between polishing substrates, i.e., ex-situ conditioning, concurrently with polishing a substrate, i.e., in-situ conditioning, or both.

Here, the pad conditioner assembly 110 includes a first actuator 126 disposed on the base plate 114, a conditioner arm 128 coupled to the first actuator 126, and a conditioner mounting plate 130 having the conditioner disk 124 fixedly coupled thereto. A first end of the conditioner arm 128 is coupled to the first actuator 126, and the mounting plate 130 is coupled to a second end of the conditioner arm 128 that is distal from the first end. The first actuator 126 is used to sweep the conditioner arm 128, and thus the conditioner disk 124, about an axis C so that the conditioner disk 124 oscillates between an inner radius of the polishing pad 108 and an outer radius of the polishing pad 108 while the polishing pad 108 rotates there beneath. In some embodiments, the pad conditioner assembly 110 further includes a second actuator 132 disposed at, and coupled to, the second end of the conditioner arm 128, the second actuator 132 is used to rotate the conditioner disk 124 about an axis D. Typically, the mounting plate 130 is coupled to the second actuator 132 using a shaft 134 disposed there between.

Generally, the rotating carrier assembly 104 is swept back and forth from an inner radius to an outer radius of the platen 106 while the platen 106, and thus the polishing pad 108, rotate about a platen axis B there beneath. The polishing fluid is delivered to the polishing pad 108 using the fluid delivery arm 112 positioned there over and is further delivered to a polishing interface between polishing pad 108 and the substrate 105 by the rotation of the polishing pad 108 about the platen axis B. Often, the fluid delivery arm 112 further includes a delivery extension member and a plurality of nozzles. The plurality of nozzles are used to deliver polishing fluid or relatively high pressure streams of a cleaner fluid, e.g., deionized water, to the polishing pad 108.

The carrier assembly 104 provides a mounting surface for the substrate 105. During substrate processing, the carrier assembly 104 surrounds the substrate 105 and operates as a substrate carrier. The carrier assembly 104 exerts a downward force on the substrate 105 to prevent the substrate 105 from slipping from underneath the carrier assembly 104. The substrate 105, is often vacuum-chucked to the carrier assembly 104. The carrier assembly 104 rotates about the carrier axis A, while urging the substrate 105 against the polishing pad 108. The carrier assembly 104 additionally oscillates in a radial direction over the top surface of the polishing pad.

Figure 2:
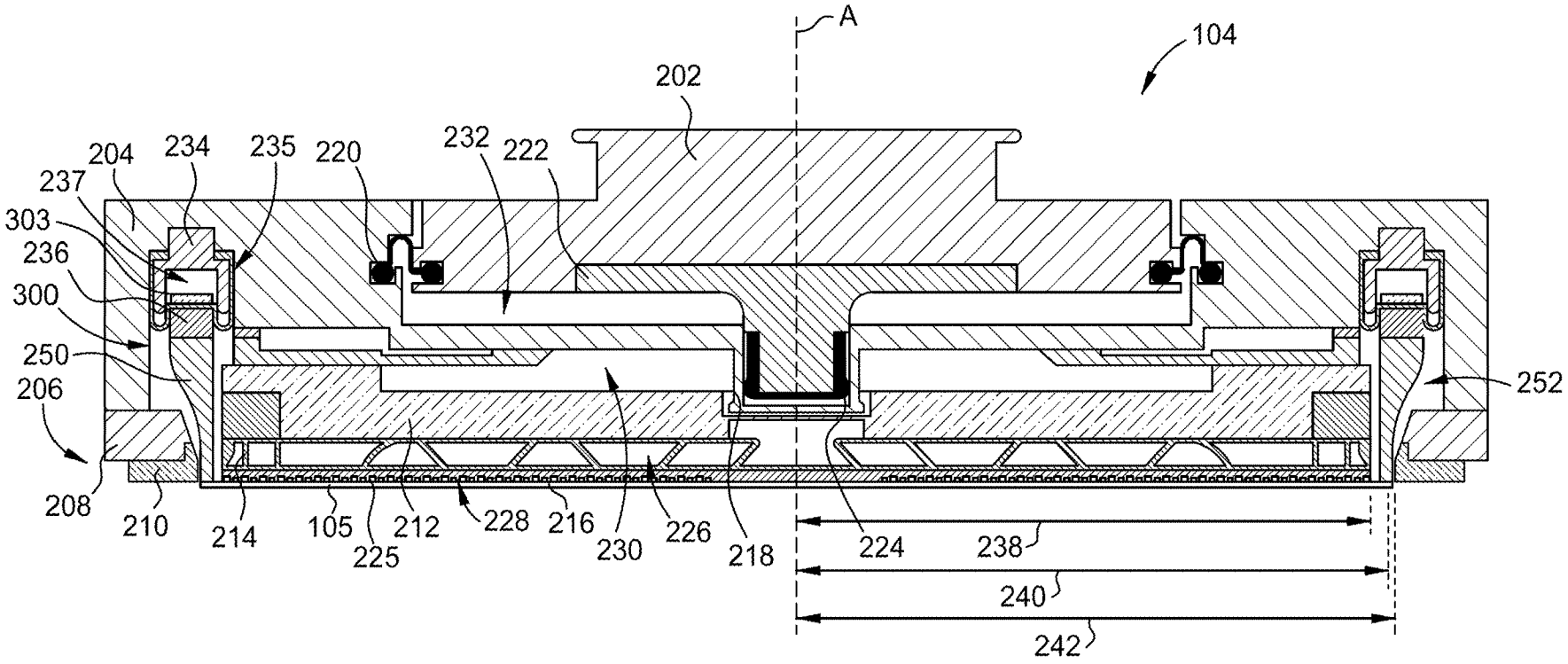
FIG. 2 is a schematic side view of a carrier assembly, such as the carrier assembly in FIG. 1 according to embodiments disclosed herein.

FIG. 2 is a schematic side view of the carrier assembly 104. The carrier assembly 104 features a housing member 202, a carrier member 204, a carrier ring assembly 206 coupled to the carrier member 204, a support plate 212 disposed radially inward of the carrier member 204 and the carrier ring assembly 206, and a second membrane 216 disposed below the support plate 212 to provide a mounting surface for the substrate 105. For the description of FIGS. 2 and 3, the term radially outward is used with reference to the central axis A of the carrier assembly 104 (FIG. 1) unless stated otherwise.

As described above, the carrier assembly 104 of FIG. 2 is used to apply pressure to a substrate, such as the substrate 105. The pressure is exerted by the carrier assembly 104 and pushes the substrate 105 into the polishing pad 108 to be polished. The carrier assembly 104 is configured to retain the substrate 105 underneath the carrier assembly 104 throughout the polishing process. In some instances, the substrate 105 and/or the entire support plate 212 and the second membrane 216 are moveable within a carrier volume 252. The carrier volume 252 is defined as the volume underneath the carrier assembly 104 and above the polishing pad 108 (FIG. 1). The majority of the carrier volume 252 is occupied by the support plate 212 and the second membrane 216.

The housing member 202 is a support member and an uppermost portion of the carrier assembly 104. The housing member 202 includes a centering piece 222, which is disposed on the bottom surface of the housing member 202 and is centered about the central axis A. The centering piece 222 further includes a cover 224. The cover 224 is disposed about a portion of an extension of the centering piece 222, which extends downwards. The cover 224 is configured to reduce the friction force between the centering piece and a depression within the carrier member 204. The carrier member 204 is disposed around and coupled to the housing member 202. The carrier member 204 is disposed around each of the support plate 212 and the substrate chucking membrane 215. The carrier member 204 covers each of the support plate 212 and the substrate chucking membrane 215. The carrier member 204 is disposed radially outward of the support plate 212 and the housing member 202. The carrier member 204 includes an outer ring which extends downward and around the outer diameters of the support plate 212 and the substrate chucking membrane 215.

The carrier ring assembly 206 is attached to an outer portion of the carrier member 204 and includes a lower annular portion and an upper annular portion, such as a substrate retaining ring 210 and a backing ring 208 respectively. The substrate retaining ring 210 is typically formed of a polymer which is bonded to the backing ring 208 using a bonding layer (not shown) disposed therein. The backing ring 208 is formed of a rigid material, such as a metal or ceramic, and is secured to the carrier member 204 using a plurality of fasteners (not shown). Examples of suitable materials used to form the substrate retaining ring 210 and the backing ring 208 respectively include any one or combination of the polishing fluid chemical resistant polymers, metals, and/or ceramics described herein.

During substrate processing, the substrate retaining ring 210 surrounds the substrate 105 to prevent the substrate 105 from slipping from underneath the carrier assembly 104. Typically, a first volume 230 is pressurized during polishing to cause the support plate 212 and the second membrane 216 to exert a downward force on the substrate 105 while the carrier assembly 104 rotates about the carrier axis A, thus urging the substrate 105 against the polishing pad 108 (FIG. 1). Before and after polishing, a vacuum is applied to the first volume 230 so that the second membrane 216 is deflected upwards to create a low pressure pocket between the second membrane 216 and the substrate 105, thus vacuum-chucking the substrate 105 to the carrier assembly 104.

Generally, the inner diameter of the substrate retaining ring 210 is greater than the diameter of the substrate 105 to allow for some clearance there between during the polishing process and substrate loading and unloading operations, such as greater than about 2 mm or more, or greater than about 3 mm or more. Similarly, the outer diameter of the substrate mounting surface of the second membrane 216 is less than the inner diameter of the substrate retaining ring 210 to allow the second membrane 216 to move relative thereto. The clearance between the substrate 105 and the substrate retaining ring 210 and between the second membrane 216 and the substrate retaining ring 210 creates a gap.

The second membrane 216 is coupled to the bottom of the support plate 212. The second membrane 216 includes multiple layers and is configured to grip the surface of the substrate 105 by applying a vacuum force. The second membrane 216 extends across substantially the entire bottom surface of the support plate 212.

The second membrane 216 includes a first membrane 214 and a second membrane 216. The first membrane 214 includes a plurality of channels 226 formed therethrough. One or more of the channels 226 are annular and are centered about the axis A. In one embodiment, one central channel 226 is disposed through the axis A and eight annular channels 226 are disposed around the central channel 226 and the axis A to equal a total of nine channels 226 disposed through the first membrane 214 of the second membrane 216. In some embodiments, about 5 channels 226 to about 15 channels 226, such as about 6 channels 226 to about 12 channels 226, such as about 7 channels 226 to about 10 channels 226 may be included. Each of the channels 226 are in fluid communication with gas passages formed through the support plate 212. The channels 226 distribute gases and gas pressure equally about the axis A. The first membrane 214 of the second membrane 216 is a stiff material, such as a hard plastic material and allows minimal deflection of the first membrane as the pressure within each of the annular channels 226 is increased or reduced.

The second membrane 216 is disposed on the bottom surface of the first membrane 214. The second membrane 216 includes a soft material, such that at least the bottom surface of the second membrane 216 is easily deflected. The second membrane 216 may be a soft plastic or a silicon material. In some embodiments, the second membrane 216 includes multiple layers which include both pliable and rigid materials. The second membrane 216 includes a chucking surface 228 and a plurality of grooves 225 disposed through the chucking surface 228. The chucking surface 228 and the grooves 225 are pliable, so that when a substrate, such as the substrate 105 comes into contact with the chucking surface 228, the chucking surface 228 deforms without damaging the substrate 105. The grooves 225 are in fluid communication with one or more of the channels 226. Pressure changes within the one or more channels 226 changes the pressure within the grooves 225 and creates a chucking or de-chucking action between the substrate 105 and the second membrane 216. The chucking force at different locations of the surface of the substrate 105 is controlled by controlling the pressure applied to the backside of the substrate 105 through the channels 226 and the grooves 225. The pressure within each of the channels 226 may be altered throughout a substrate polishing process to improve the uniformity of the polishing process.

The support plate 212 and the second membrane 216 are attached to the carrier member 204 using a first flexible support 218 as described herein. The first flexible support 218 is an annular flexure and allows the substrate 105, the support plate 212, and the second membrane 216 to move relative to the carrier member 204 during substrate processing in both a vertical and a horizontal direction (wherein the vertical direction is parallel to the axis A and the horizontal direction is parallel to the top surface of the polishing pad 108 (FIG. 1). The support plate 212, the carrier member 204, and the first flexible support 218 collectively define the first volume 230 between the support plate 212 and the carrier member 204. The first flexible support 218 may bend to allow vertical movement of the support plate 212 with respect to the carrier member 204. The first flexible support 218 simultaneously supports the load of the support plate 212 while allowing for controlled movement of the support plate 212.

A second flexible support 220 is disposed between the carrier member 204 and the housing member 202. The second flexible support 220 is an annular support coupling the carrier member 204 to the housing member 202. A second volume 232 is defined between the carrier member 204 and the housing member 202. The second flexible support 220 forms a seal between the carrier member 204 and the housing member 202 in order to allow the second volume 232 to be pumped to either a higher or a lower pressure than the surrounding environment. The pressure within the second volume 232 influences the vertical deflection of the carrier member 204 with respect to the housing member 202.

In some embodiments, the radius of the substrate 105 is defined as a first radius 240. The first radius 224 may be about 151 mm to about 155 mm, such as about 151 mm to about 153 mm, such as about 152 mm to about 153 mm. The outer radius of the second membrane 216 is defined as a second radius 238. The second radius 238 may be about 140 mm to about 155 mm, such as about 145 mm to about 152 mm, such as about 150 mm. The second radius 238 may be about 0.5% to about 2% smaller than the first radius 240. The inner radius of the substrate retaining ring 210 is defined as a third radius 242. The third radius 242 may be about 153 mm to about 156 mm, such as about 153 mm to about 155 mm, such as about 154 mm to about 155 mm. The third radius 242 may be about 3% to about 5% larger than the first radius 240, such as about 3% to about 4% larger than the first radius 240, such as about 3.5% to about 4% larger than the first radius 240.

The carrier 104 also includes a distal force assembly 300. The distal force assembly 300 is disposed radially outward of the support plate 212 and radially inward of an exterior portion of the carrier member 204. The distal force assembly 300 is a radial assembly and forms a ring within the carrier 104, for example, the distal force assembly 300 is a circular assembly. The distal force assembly 300 includes a bladder seal 235, a bladder frame 234, a stiffener 303, and a seal ring 236. The bladder seal 235 is disposed between the bladder frame 234 and the seal ring 236. The bladder frame 234 and the seal ring 236 are annular and are coupled together to form the distal force assembly 300. In some embodiments, the seal ring 236 is a metal seal ring.

The bladder seal 235 has a hardness between about 54 and about 66 on the Shore A Hardness scale. For example, the bladder seal 235 has a hardness greater than about 40 on the Shore A Hardness scale. For example, the bladder seal 235 has a 60+/−5 hardness. The minimum tear strength of the bladder seal 235 is between about 15 kilonewtons (kN) per meter and about 19 kN per meter. For example, the minimum tear strength of the bladder seal 235 is about 17 KN per meter. The minimum tensile strength of the bladder seal 235 is between about 6 megapascals (MPa) and about 7 MPa. For example, the minimum tensile strength of the bladder seal 235 is about 6.5 MPa.

In some embodiments, the bladder seal 235 includes a coating. The bladder seal 235 coating may be a parylene C coating with a coating thickness of about 0.3 microns to about 0.8 microns. For example, the parylene coating of the bladder seal 235 may be about 0.4 microns to about 0.7 microns thick.

The seal ring 236 is coupled to a transfer ring 250. In some embodiments, the transfer ring 250 is bonded to the seal ring 236 by an adhesive. The seal ring 236 is disposed between the transfer ring 250 and the bladder seal 235. In some embodiments, the seal ring 236 is a metal, for example stainless steel. In some embodiments, the seal ring 236 is a rigid polymer. In some embodiments, the transfer ring 250 is a rigid polymer. For example, the transfer ring 250 is Polytetrafluoroethylene (PTFE).

The bladder frame 234 and the bladder seal 235 form a seal cavity 237. The stiffener 303 is disposed within the seal cavity 237. The sealed cavity 237 may be inflated or deflated to translate the seal ring 236 and transfer ring 250 relative to the carrier member 204 and to apply distal force to the substrate.

Figure 3:
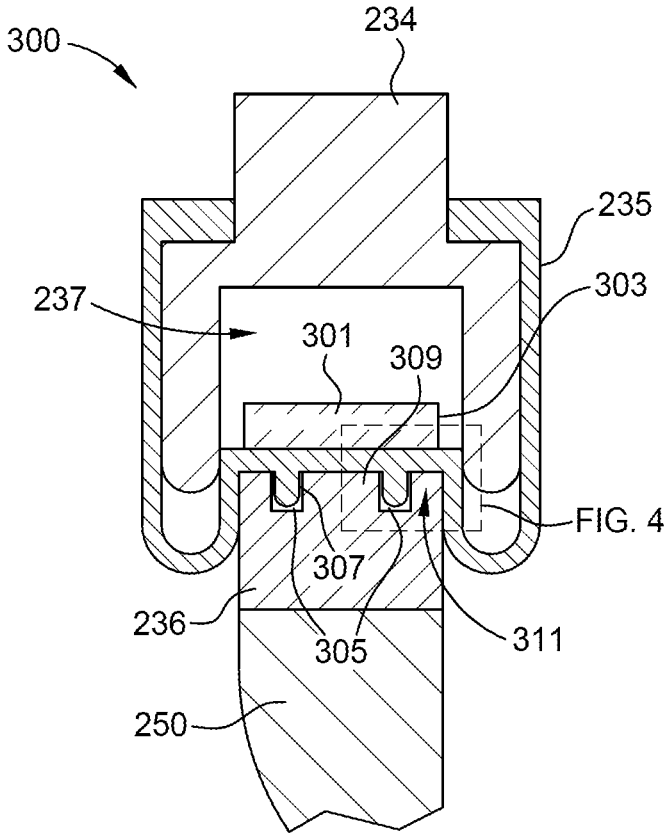
FIG. 3 is an enlarged cross sectional view of a distal force assembly according to embodiments disclosed herein.

FIG. 3 illustrates additional details of the interaction between the seal ring 236 and the bladder seal 235 of the distal force assembly 300. The distal force assembly 300 also includes a sealing hardware 301. According to some embodiments, the sealing hardware 301 is a bolt, a machine screw, but other embodiments are contemplated. In other embodiments, the sealing hardware 301 is a distribution ring with bolts through the distribution ring. The sealing hardware 301 aids in sealing the bladder seal 235 to the seal ring 236. The sealing hardware 301 is described in more detail below.

The seal ring 236 includes one or more grooves 305 (two shown). The grooves 305 are configured to receive one or more seal features 307 of the bladder seal 235. The seal features 307 and the grooves 305 provide a sealed space within the seal cavity 237 such that precise pressure control can be achieved with respect to the force applied to the edge of a substrate. The seal features 307 also align the bladder seal 235 with the grooves 305

The grooves 305 define a plateau region 309. For example, the plateau region 309 is disposed between grooves 305. In yet another example, the plateau region 309 is disposed between two grooves 305. The bladder seal 235 rests on the plateau region 309. The bladder seal 235 is disposed between the plateau region 309 and the sealing hardware 301.

One or more ridge regions 311 are disposed outward of the plateau region 309 and are separated from the plateau region 309 by the grooves 305.

Figure 4:
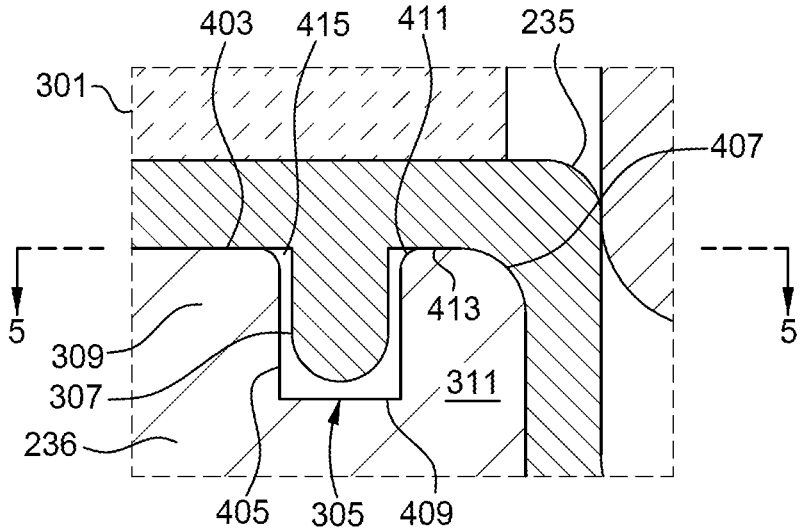
FIG. 4 is an enlarged cross sectional view of a distal force assembly according to embodiments disclosed herein.

FIG. 4 further illustrates the interaction of the bladder seal 235 and the seal ring 236. The grooves 305 are recesses in a seal ring face 403. The grooves 305 have a bottom face 409, side walls 405, a plateau radius 415, and a ridge radius 411. The ridge regions 311 include an outer radius 407.

The ridge regions 311 include ridge faces 413. The ridge faces 413 are the faces of the seal ring face 403 separated from the plateau region 309 by the grooves 305.

The plateau radius 415 is the radius formed between the grooves 305 and the seal ring face 403 disposed on the plateau region 309. The ridge radius 411 is the radius formed between the grooves 305 and the ridge faces 413 disposed on the ridge regions 311.

The plateau radius 415 and the ridge radius 411 are disposed opposite each other with a groove 305 between them. The plateau radius 415 are disposed inward of the ridge radius 411. In some embodiments, the plateau radius 415, the ridge radius 411, and the outer radius 407 have about the same radius. For example, the radii 407, 411, 415 may have a radius of between about 0.012 inches and about 0.018 inches. For example, the radii 407, 411, 415 may have a radius of about 0.014 inches. In other embodiments the radii 407, 411, 415 might have different radii. In yet another embodiment, the plateau radius 415 and the ridge radius 411 have about equal radii, different from the outer radius 407. For example, the plateau radius 415 and the ridge radius 411 have radii of between about 0.012 inches and about 0.018 inches. For example, the plateau radius 415 and the ridge radius 411 have radii of about 0.014 inches.

Figure 5:
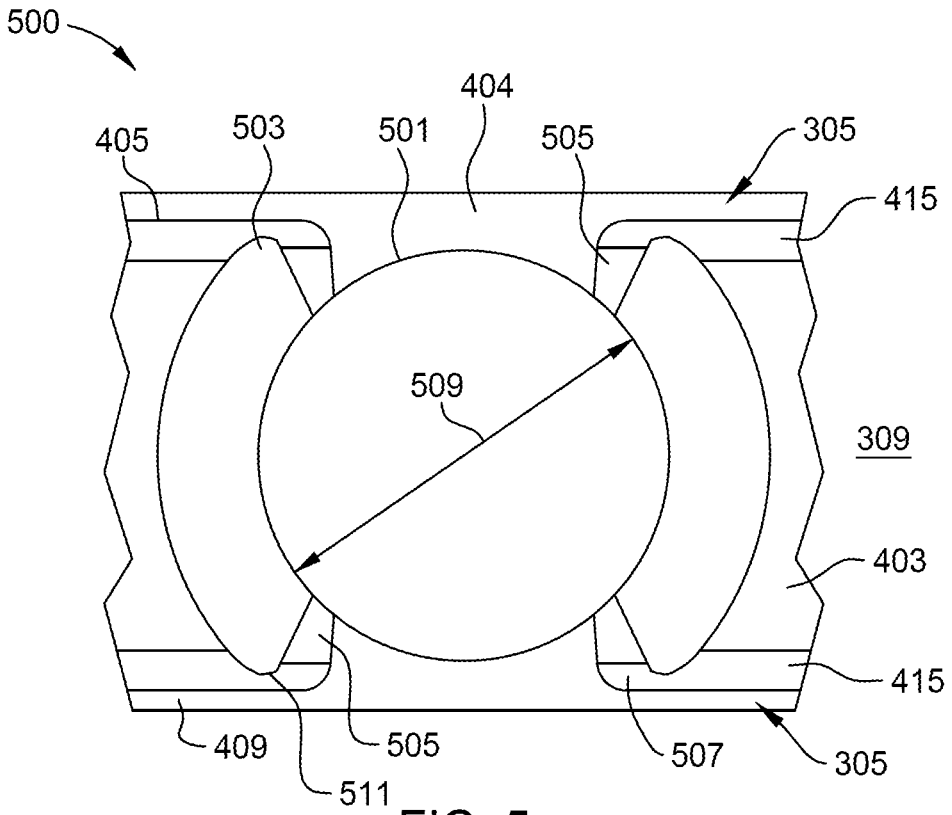
FIG. 5 is an enlarged top view of a seal mount according to embodiments disclosed herein.

FIG. 5 illustrates a seal mount 500 of a plurality of seal mounts 500 according to some embodiments. Each seal mount 500 of the plurality of seal mounts includes a bolt hole 501 disposed in the seal ring face 403 of the plateau region 309. The bolt hole 501 is configured to receive the sealing hardware 301 (FIG. 4). As the sealing hardware 301 (FIG. 4) is affixed into the bolt hole 501 it compresses the bladder seal 235 against the seal ring 236. During use, prior art seal ring and bladder seal combinations lead to premature seal failure. The inventors have significantly increased the life span at least by the above mentioned changes to the seal ring 236 (FIG. 4) and the seal mount 500 described below.

Each seal mount 500 includes a pair of receiving faces 503, one or more interior features 505, and one or more exterior features 507. Each receiving face 503 is a face that is curved between the side walls 405 of the grooves 305. Each receiving face 503 is a face that slopes down from the seal ring face 403 of the plateau region 309 to the bottom face 409 of the grooves 305. The receiving face 503 is configured to receive the sealing hardware 301 (FIG. 4) and reduce sharp edges and corners that could tear the bladder seal 235 (FIG. 4).

The receiving face 503 intersects the bolt hole 501 at the bolt hole diameter 509. The bolt hole diameter 509 is between about 2 millimeters and about 20 millimeters, for example about 5 millimeters.

According to some embodiments the interior features 505 and the exterior features 507 are sloped faces.

According to some embodiments the interior features 505 are angled faces that slope towards the bottom face 409 from the receiving faces 503. The interior features 505 angle from the receiving faces 503 to the bottom face 409 towards the bolt hole 501. The interior features 505 serve to make the angle between the receiving face 503 and the interior features 505 a gradual slope down to the bottom face 409 instead of a harder more acute angle. If the interior features 505 were faces perpendicular to the bottom face 409, there would be a sharp edge that can wear down the bladder seal 235. The interior features 505 assist at least in increasing the life of the bladder seal 235. The interior features 505 also form an edge with the exterior features 507.

According to some embodiments, the exterior features 507 are angled faces that slope towards the bottom face 409 from the receiving faces 503 and the interior features 505. The exterior features 507 angle from the receiving faces 503 to the bottom face 409 away the bolt hole 501. The exterior features 507 are disposed radially outward of the interior features 505. The exterior features 507 serve to make the angle between the receiving face 503 and the exterior features 507 a gradual slope toward the bottom face 409, the adjacent groove 305, and along the side walls 405 instead of a harder more acute angle. The exterior features 507 assist at least in increasing the life of the bladder seal 235.

In some embodiments, a radius 511 is also disposed at each intersection of the exterior features 507, interior features 505, and the receiving faces 503. The radius 511 is between about 0.1 millimeters and 0.5 millimeters. For example, the radius 511 is about 0.3 millimeters.

The features described above enable a carrier head with enhanced life and better durability compared to previous designs.

While the foregoing is directed to embodiments of the present disclosure, other and further embodiments of the disclosure may be devised without departing from the basic scope thereof, and the scope thereof is determined by the claims that follow.

What is claimed is:

1. An apparatus for substrate polishing, comprising:

a housing member;

a carrier member coupled to and disposed radially outward of the housing member; and a distal force assembly disposed radially inward of an exterior portion of the carrier member and radially outward of the housing member, the distal force assembly comprising:

a bladder seal;

a seal ring in contact with the bladder seal, the seal ring having a seal ring face and one or more grooves disposed in the seal ring face, the grooves comprising:

a plateau radius disposed at an intersection between the seal ring face and the one or more grooves; and a ridge radius disposed opposite the plateau radius at an intersection between the seal ring face and the grooves, wherein the plateau radius and the ridge radius are between about 0.012 to about 0.018 inches; and a transfer ring coupled to the seal ring opposite the bladder seal, wherein the one or more grooves form a plateau region in the seal ring face, and wherein the plateau region has a plurality of seal mounts, each seal mount of the plurality of seal mounts comprises a receiving face and one or more features, the features being sloped faces.

2. The apparatus of claim 1, wherein the seal ring is stainless steel and the transfer ring is a polymer.

3. The apparatus of claim 1, wherein the receiving face slopes from the seal ring face towards a bolt hole in the seal ring.

4. The apparatus of claim 3, the bladder seal includes a coating, the coating having a thickness between about 0.3 and about 0.8 microns thick.

5. The apparatus of claim 4, wherein the bladder seal has a hardness of greater than about 40 on the Shore A hardness scale.

6. A distal force assembly for use in a substrate carrier, comprising:

a bladder seal;

a seal ring in contact with the bladder seal, the seal ring having a seal ring face and two or more grooves disposed in the seal ring face, the two or more grooves comprising:

a plateau radius disposed at an intersection between the seal ring face and the two or more grooves; and a ridge radius disposed opposite the plateau radius at an intersection between the seal ring face and the two or more grooves, wherein the plateau radius and the ridge radius are between about 0.012 to about 0.018 inches; and a transfer ring coupled to the seal ring opposite the bladder seal, a seal mount disposed between two of the two or more grooves; and sealing hardware disposed through the bladder seal and connecting the bladder seal to the seal ring, wherein the seal mount comprises:

an interior feature, the interior feature being an angled face that slopes towards a bottom face of the two or more grooves from the receiving face; and an exterior feature, the exterior feature being an angled face that slopes towards the bottom face of the two or more grooves from a receiving face and the interior feature.

7. The distal force assembly of claim 6, wherein the distal force assembly is circular assembly.

8. The distal force assembly of claim 6, wherein the bladder seal comprises one or more seal features configured to align with the two or more grooves of the seal ring.

9. The distal force assembly of claim 6, wherein bladder seal has a hardness of greater than about 40 on the Shore A hardness scale.

10. The distal force assembly of claim 6, wherein the plateau radius and the ridge radius are about equal.

11. The distal force assembly of claim 6, wherein the ridge radius is between about 0.014 inches.

12. A metal seal ring for use in a distal force assembly of a substrate polishing apparatus, comprising:

a plateau region disposed between two grooves, the plateau region and two grooves disposed on a seal ring face of the seal ring, the two grooves comprising:

a plateau radius disposed at an intersection between the seal ring face and the two grooves; and a ridge radius disposed opposite the plateau radius at an intersection between the seal ring face and the two grooves, wherein the plateau radius and the ridge radius are between about 0.012 to about 0.018 inches, wherein the metal seal ring further comprises a seal mount, the seal mount having a receiving face that slopes from the seal ring face to a bottom face of the two grooves.

13. The metal seal ring of claim 12, wherein the plateau radius is disposed opposite the ridge radius.

14. The metal seal ring of claim 12, wherein the seal mount comprises:

an interior feature, the interior feature being an angled face that slopes towards the bottom face of the two grooves from the receiving face; and an exterior feature, the exterior feature being an angled face that slopes towards the bottom face of the two grooves from the receiving face and the interior feature.

* * * * *